US012427369B2

(12) United States Patent
Luo

(10) Patent No.: US 12,427,369 B2
(45) Date of Patent: Sep. 30, 2025

(54) HANDRAIL FOLDING STRUCTURE FOR TREADMILL

(71) Applicant: Jiangxi EQI Industrial Co. Ltd, Xiushui (CN)

(72) Inventor: Xietong Luo, Xiushui (CN)

(73) Assignee: Jiangxi EQI Industrial Co. Ltd, Xiushui (CN)

( * ) Notice: Subject to any disclaimer, the term of this patent is extended or adjusted under 35 U.S.C. 154(b) by 101 days.

(21) Appl. No.: 18/597,810

(22) Filed: Mar. 6, 2024

(65) Prior Publication Data

US 2025/0195943 A1 Jun. 19, 2025

(30) Foreign Application Priority Data

Dec. 15, 2023 (CN) ..... 202323439852.4

(51) Int. Cl.
*A63B 22/02* (2006.01)

(52) U.S. Cl.
CPC ..... *A63B 22/02* (2013.01); *A63B 2210/50* (2013.01)

(58) Field of Classification Search
CPC ..... A63B 22/0046; A63B 22/02; A63B 26/00; A63B 26/003; A63B 2069/0037; A63B 71/0009; A63B 71/0036; A63B 71/0054; A63B 2071/0072; A63B 2210/00; A63B 2210/50
See application file for complete search history.

(56) References Cited

U.S. PATENT DOCUMENTS

2009/0075784 A1* 3/2009 Hoggan ..... A63B 22/0012 482/54
2010/0279827 A1* 11/2010 Farnsworth ..... A63B 21/4035 482/54

FOREIGN PATENT DOCUMENTS

| | | | | |
|---|---|---|---|---|
| CN | 107866035 A | * | 4/2018 | ..... A63B 22/02 |
| CN | 207640889 U | * | 7/2018 | |
| CN | 114191777 A | * | 3/2022 | ..... A63B 22/0235 |
| CN | 215938914 U | * | 3/2022 | |
| CN | 114504766 A | * | 5/2022 | ..... A63B 22/02 |
| CN | 217311784 U | * | 8/2022 | |
| CN | 217645761 U | * | 10/2022 | |
| CN | 219333087 U | * | 7/2023 | ..... F16B 5/02 |
| CN | 116785643 A | * | 9/2023 | ..... A63B 22/02 |
| CN | 220632898 U | * | 3/2024 | ..... A63B 21/4035 |

* cited by examiner

*Primary Examiner* — Gary D Urbiel Goldner
(74) *Attorney, Agent, or Firm* — Andrew C. Cheng

(57) ABSTRACT

A handrail folding structure for a treadmill includes a pillar, a handrail, and a hinge assembly. The hinge assembly includes a first shaft, a second shaft, and a pin. The first shaft is fixed on the pillar, the second shaft is fixed on the handrail, and the second shaft is rotatably connected to the first shaft through the pin. The second shaft can rotate relative to the first shaft. The first shaft is provided with a first limiting portion, and the second shaft is provided with a second limiting portion for abutting against and cooperating with the first limiting portion. The first limiting portion is located on a rotation path of the second limiting portion. When the handrail is in an unfolded or folded state, the first limiting portion abuts against the second limiting portion.

16 Claims, 8 Drawing Sheets

HANDRAIL FOLDING STRUCTURE FOR TREADMILL

TECHNICAL FIELD

The present application relates to the technical field of treadmill structure, and in particular, to a handrail folding structure for treadmill.

BACKGROUND

A treadmill is a commonly used fitness equipment in homes and gyms, which generally comes in two types: with and without the handrails. A common treadmill with the handrails is usually provided with the handrails on the pillars of the treadmill. For the convenience of transportation, use, and placement, the handrails of the treadmill usually adopt a folding structure, that is, the handrails have two states of unfolding and folding. When in use, the handrail is rotated to the unfolded state, at which point the handrail is roughly horizontal, making it easy for the user to grip. When not in use, the handrail is rotated to the folded state for storage, with the handrail parallel to the pillar.

Some of the existing treadmills use a folding handrail structure. When the handrail is rotated to the folded state, the handrail is in a free state, which not only causes wear because of shaking during transportation, but also poses safety hazards. In order to fix the position of the handrail in the folded state, some treadmills are provided with a locking mechanism on the handrail, so as to use the locking mechanism to lock and unlock the handrail. However, this method increases the complexity of the structure, causing the disassembly and assembly process very cumbersome, and increases production costs. In addition, the locking mechanism is prone to failure with low reliability after long-term use.

SUMMARY

The object of the present application is to provide a handrail folding structure for treadmill, which can limit the position of the handrail in the unfolded and folded states, and has a simple structure, high reliability, and is easy to install and disassemble.

The present application provides a handrail folding structure for treadmill, including a pillar, a handrail, and a hinge assembly, wherein the hinge assembly includes a first shaft, a second shaft, and a pin, wherein the first shaft is fixed on the pillar, the second shaft is fixed on the handrail, the second shaft is rotatably connected to the first shaft through the pin, and the second shaft can rotate relative to the first shaft;

the first shaft is provided with a first limiting portion, and the second shaft is provided with a second limiting portion for abutting against and cooperating with the first limiting portion, the first limiting portion is located on the rotation path of the second limiting portion, and when the handrail is in an unfolded or folded state, the first limiting portion abuts against the second limiting portion.

In an achievable manner, along the rotation direction of the second shaft, the first limiting portion has a first limiting surface and a second limiting surface which are located at two opposite sides of the first limiting portion, and the second limiting portion has a first stopping surface and a second stopping surface which are located at two opposite sides of the second limiting portion;

when the handrail is in the unfolded state, the first stopping surface abuts against the first limiting surface, and when the handrail is in the folded state, the second stopping surface abuts against the second limiting surface.

In an achievable manner, the number of the first limiting portion is one, and the first limiting surface and the second limiting surface are both formed on the same first limiting portion; or, the number of the first limiting portion is two, and the two first limiting portions are spaced from each other along the rotation direction of the second shaft, the first limiting surface and the second limiting surface are separately formed on different first limiting portions.

In an achievable manner, the number of the second limiting portion is one, and the first stopping surface and the second stopping surface are both formed on the same second limiting portion; or, the number of the second limiting portion is two, and the two second limiting portions are spaced from each other along the rotation direction of the second shaft, the first stopping surface and the second stopping surface are separately formed on different second limiting portions.

In an achievable manner, the first shaft has a first end face facing the second shaft, the second shaft has a second end face facing the first shaft, the first end face faces and spaced apart from the second end face, the first limiting portion is protruded on the first end face, and the second limiting portion is protruded on the second end face.

In an achievable manner, both the first shaft and the second shaft are cylindrical structures, and the first shaft and the second shaft are arranged coaxially.

In an achievable manner, the pin is fixedly connected to the first shaft, and the second shaft is rotatably connected to the pin.

In an achievable manner, the pin includes a rod and a stop portion which are interconnected to each other, with the outer diameter of the stop portion greater than that of the rod; the rod is inserted into both the second shaft and the first shaft, one end of the rod that is far away from the stop portion is fixedly connected to the first shaft, the second shaft can rotate relative to the rod, the stop portion is located at one end of the second shaft away from the first shaft.

In an achievable manner, the hinge assembly further includes a corrugated gasket sleeved on the pin, and the corrugated gasket is sandwiched between the stop portion and one end face of the second shaft that is away from the first shaft.

In an achievable manner, a through hole is provided in the second shaft, the through hole runs axially through the second shaft, a mounting hole is axially provided in the first shaft, and the rod is inserted into the mounting hole after passing through the through hole.

In an achievable manner, the inner wall of the mounting hole is provided with a first step, the outer wall of the rod is provided with a second step, and the second step abuts against the first step.

In an achievable manner, the mounting hole includes a first inner hole and a second inner hole which are interconnected to each other, with the diameter of the first inner hole greater than that of the second inner hole, and the first step is formed between of the first inner hole and the second inner hole; the rod includes a first rod section and a second rod section which are interconnected to each other, with the outer diameter of the first rod section greater than that of the second rod section, and the second step is formed between the first rod section and the second rod section, wherein the second rod section is received in the second inner hole, and one end of the first rod section near the second rod section is received in the first inner hole.

In an achievable manner, the rod is provided with an external thread on the outer wall corresponding to the position of the first shaft, the inner wall of the first shaft is provided with an internal thread, and the rod is threadedly connected to the first shaft.

In an achievable manner, an accommodating groove is provided in the end face of the second shaft that is away from the first shaft, and the stop portion is accommodated in the accommodating groove.

In an achievable manner, the first shaft includes an insertion portion and an abutting portion which are interconnected to each other, with the outer diameter of the abutting portion greater than that of the insertion portion; the pillar is provided with a fixing hole, the insertion portion is inserted into the fixing hole, the abutting portion abuts against the side wall of the pillar, and the first shaft is fixed to the pillar by welding.

In an achievable manner, one end of the handrail is provided with a semi-circular groove, the second shaft is disposed in the semi-circular groove, the outer wall of the second shaft is in contact with the inner wall of the semi-circular groove, and the second shaft is fixed to the handrail by welding.

The present application further provides a treadmill including the handrail folding structure for treadmill mentioned above.

The handrail folding structure for treadmill in the present application is provided with a hinge assembly. The hinge assembly includes a first shaft fixed on a pillar and a second shaft fixed on the handrail. The second shaft is rotatably connected to the first shaft through a pin, allowing the handrail to rotate relative to the pillar, thereby enabling the handrail to unfold and fold. Meanwhile, by setting the first limiting portion and the second limiting portion respectively on the first shaft and the second shaft, the first limiting portion and the second limiting portion can abut against and cooperate with each other. When the handrail is in an unfolded state, the first limiting portion abuts against the second limiting portion, thereby keeping the handrail in the unfolded state. When the handrail is in a folded state, the first limiting portion also abuts against the second limiting portion, thereby limiting the handrail and reducing or avoiding the wear and safety issues caused by the free rotation of the handrail in the folded state. The handrail folding structure for treadmill not only can limit the position of the handrail in the unfolded and folded states, but also has a simple structure, high reliability, and is easy to install and disassemble.

DETAILED DESCRIPTION OF THE EMBODIMENTS

Figure 1:
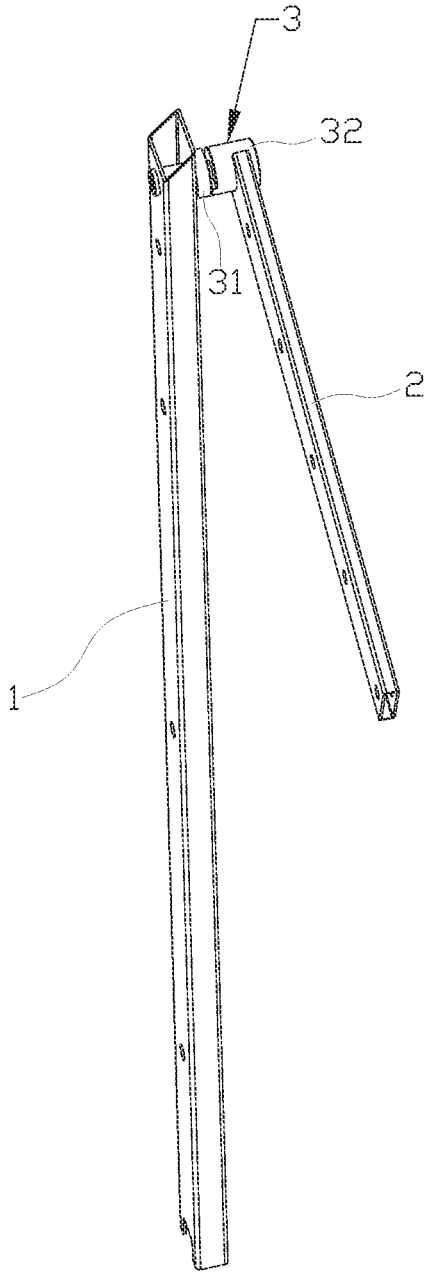
FIG. 1 is a structural schematic diagram of the handrail folding structure for treadmill in an embodiment of the present application.

The following will provide a further detailed description of the specific implementations of the present application in conjunction with the accompanying drawings and embodiments. The following embodiments are used to illustrate the present application, but are not intended to limit the scope of the present application.

The terms "first", "second", "third", "fourth", etc. (if any) in the specification and claims of the present application are only used to distinguish similar objects, and are not intended to be used to describe a specific sequence or order.

The terms "up", "down", "left", "right", "front", "back", "top", "bottom" (if any) in the specification and claims of the present application are defined based on the position of the structure in the figures and the position between the structures in the figures, only for the clarity and convenience of expressing the technical solution. It should be understood that the use of these directional words should not limit the scope of protection in the present application.

As shown in FIG. 1 to FIG. 5, a handrail folding structure for treadmill provided in an embodiment of the present application includes a pillar 1, a handrail 2, and a hinge assembly 3, with the handrail 2 located on one side of the pillar 1. The hinge assembly 3 includes a first shaft 31, a second shaft 32, and a pin 33. The first shaft 31 is fixed on the pillar 1, and the second shaft 32 is fixed on the handrail 2. The second shaft 32 is located on one side of the first shaft 31, and the first shaft 31 and the second shaft 32 are arranged coaxially. The second shaft 32 is rotationally connected to the first shaft 31 through the pin 33, and the second shaft 32 can rotate relative to the first shaft 31.

The first shaft 31 is provided with a first limiting portion 311, and the second shaft 32 is provided with a second limiting portion 321 for abutting against and cooperating with the first limiting portion 311. The first limiting portion 311 is located on the rotation path of the second limiting portion 321. When the handrail 2 is in an unfolded or folded state, the first limiting portion 311 abuts against the second limiting portion 321.

The handrail folding structure for treadmill in this embodiment includes a hinge assembly 3. The hinge assembly 3 includes a first shaft 31 fixed on the pillar 1 and a second shaft 32 fixed on the handrail 2. The second shaft 32 is rotatably connected to the first shaft 31 through a pin 33, allowing the handrail 2 to rotate relative to the pillar 1, thereby enabling the handrail 2 to unfold and fold. Meanwhile, by setting the first limiting portion 311 and the second limiting portion 321 respectively on the first shaft 31 and the second shaft 32, the first limiting portion 311 and the second limiting portion 321 can abut against and cooperate with each other. When the handrail 2 is in an unfolded state, the first limiting portion 311 abuts against the second limiting portion 321, thereby keeping the handrail 2 in the unfolded state. When the handrail 2 is in a folded state, the first limiting portion 311 also abuts against the second limiting portion 321, thereby limiting the handrail 2 and reducing or avoiding the wear and safety issues caused by the free rotation of the handrail 2 in the folded state. The handrail folding structure for treadmill not only can limit the position of the handrail 2 in the unfolded and folded states, but also has a simple structure, high reliability, and is easy to install and disassemble.

Figure 2A:
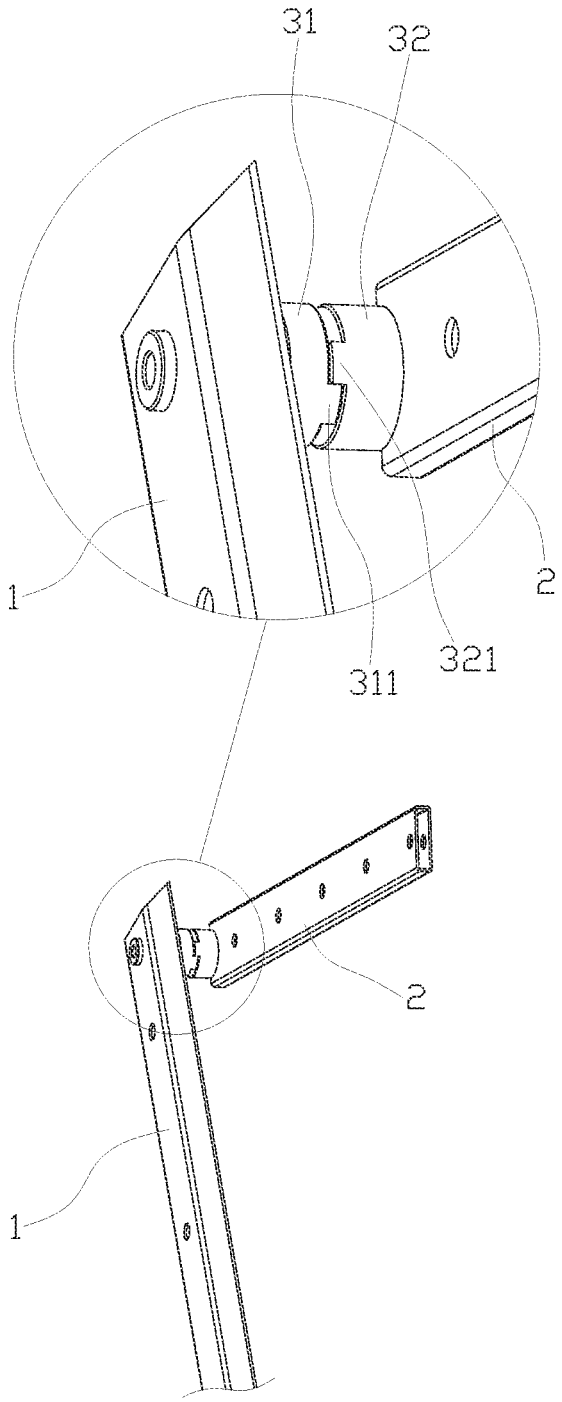
FIG. 2*a* is a structural schematic diagram of the handrail in an unfolded state in an embodiment of the present application.
Figure 2B:
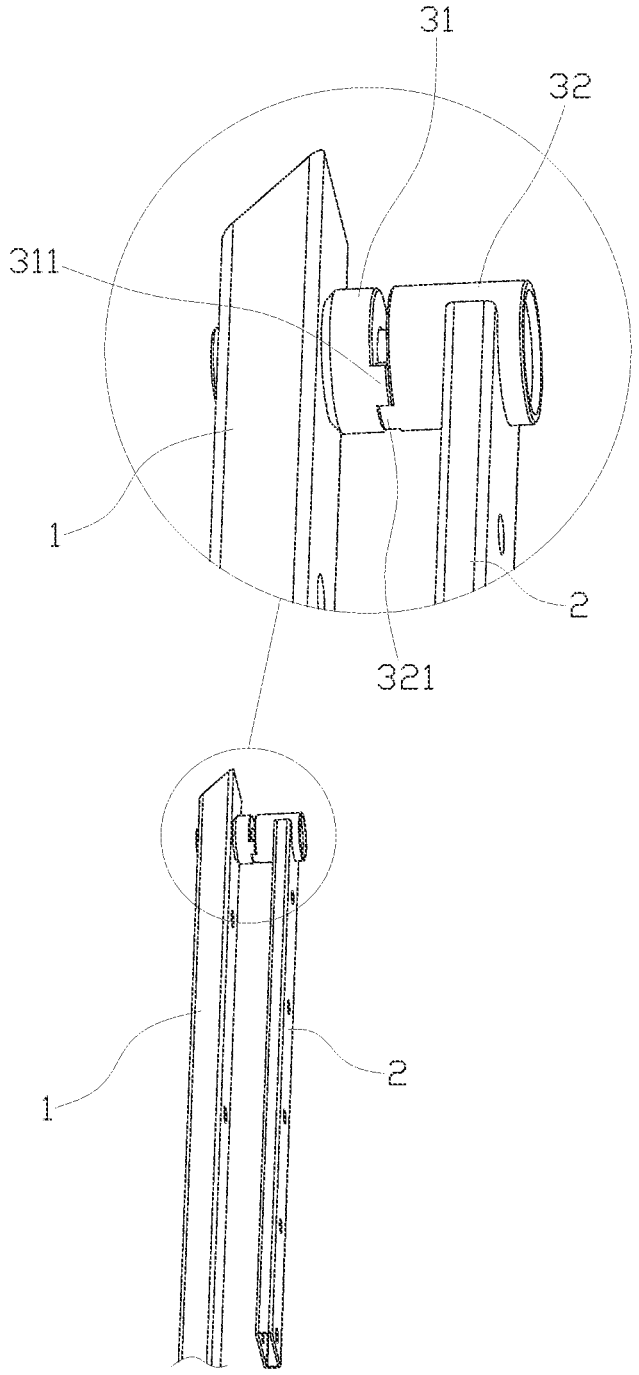
FIG. 2*b* is a structural schematic diagram of the handrail in a folded state in an embodiment of the present application.

Specifically, as shown in FIG. 2*a*, when the handrail 2 is in the unfolded state, the handrail 2 is located substantially horizontal, and at this time, the first limiting portion 311 abuts against the second limiting portion 321. On the one hand, the first limiting portion 311 plays a limiting function on the second shaft 32 and the handrail 2, preventing further rotation of the second shaft 32 and the handrail 2. On the other hand, the first limiting portion 311 also supports the second shaft 32 and the handrail 2, keeping the handrail 2 in the unfolded state, and at this time, the handrail 2 can be held and leaned by the user. As shown in FIG. 2*b*, when the handrail 2 is in the folded state, the handrail 2 is parallel to pillar 1 (that is, the length direction of the handrail 2 is parallel to the length direction of the pillar 1) to reduce the space occupied by the handrail 2, and at this time, the first limiting portion 311 abuts against the second limiting portion 321, thereby limiting the second shaft 32 and the handrail 2, preventing wear and safety issues caused by the free rotation of the handrail 2 in the folded state. Specifically, by rotating the handrail 2 relative to the pillar 1, the handrail 2 can switch between the unfolded state and the folded state. For example, if the user rotates the handrail 2 in a first direction, the handrail 2 will be rotated from the folded state as shown in FIG. 2*b* to the unfolded state as shown in FIG. 2*a*; if the user rotates the handrail 2 in a second direction that is reverse to the first direction, the handrail 2 will be rotated from the unfolded state as shown in FIG. 2*a* to the folded state as shown in FIG. 2*b*.

As shown in FIG. 1 to FIG. 5, in an achievable manner, both the first shaft 31 and the second shaft 32 are cylindrical structures, with the second shaft 32 located on one side of the first shaft 31 along the axial direction of the second shaft 32. Specifically, the first shaft 31 and the second shaft 32 are arranged coaxially.

As shown in FIG. 3 to FIG. 7, in an achievable manner, the first shaft 31 has a first end face 312 facing the second shaft 32, and the second shaft 32 has a second end face 322 facing the first shaft 31. The first end face 312 faces and spaced apart from the second end face 322. The first limiting portion 311 is protruded on the first end face 312, and the first limiting portion 311 extends and protrudes from the first end face 312 towards the second end face 322. The second limiting portion 321 is protruded on the second end face 322, and the second limiting portion 321 extends and protrudes from the second end face 322 towards the first end face 312. Along the rotation direction S of the second shaft 32 (that is, the circumferential direction of the second shaft 32), the first limiting portion 311 overlaps with the second limiting portion 321, so that during the rotation of the second shaft 32, the first limiting portion 311 can abut against the second limiting portion 321.

As shown in FIG. 3 to FIG. 7, in an achievable manner, along the rotation direction S of the second shaft 32, the first limiting portion 311 has a first limiting surface 311*a* and a second limiting surface 311*b* which are located at two opposite sides of the first limiting portion 311, and the second limiting portion 321 has a first stopping surface 321*a* and a second stopping surface 321*b* which are located at two opposite sides of the second limiting portion 321. When the handrail 2 is in the unfolded state, the first stopping surface 321*a* abuts against the first limiting surface 311*a*. When the handrail 2 is in the folded state, the second stopping surface 321*b* abuts against the second stopping surface 311*b*.

Figure 6:
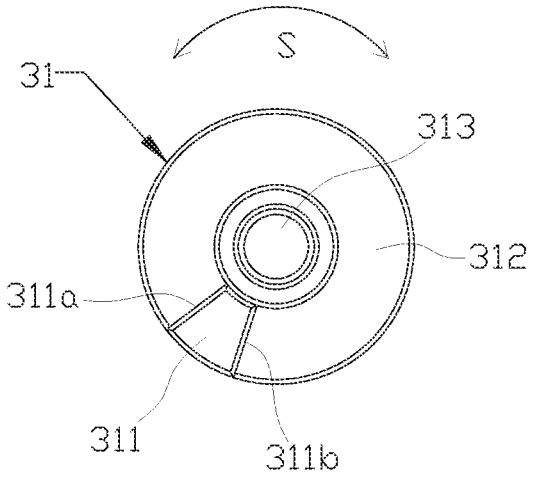
FIG. 6 is a structural schematic diagram of the first shaft in an embodiment of the present application.
Figure 7:
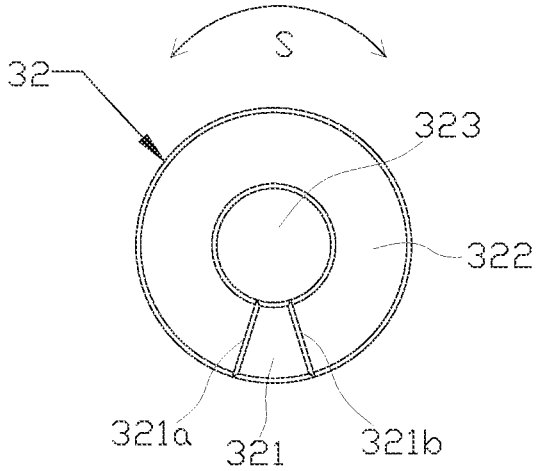
FIG. 7 is a structural schematic diagram of the second shaft in an embodiment of the present application.

As shown in FIG. 6 and FIG. 7, in an achievable manner, the number of the first limiting portion 311 is one, and the first limiting surface 311*a* and the second limiting surface 311*b* are both formed on the same first limiting portion 311. The number of the second limiting portion 321 is one, and the first stopping surface 321*a* and the second stopping surface 321*b* are both formed on the same second limiting portion 321. In order to ensure that the first limiting portion 311 can abut against the second limiting portion 321 when the handrail 2 is in both the unfolded and folded states, and to position the handrail 2 in the desired position, the width of the first limiting portion 311 and the second limiting portion 321 can be determined according to actual needs (this width refers to the width along the rotation direction S).

Figure 8:
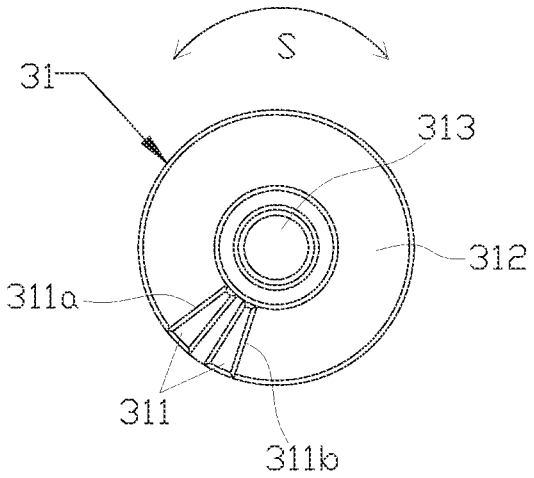
FIG. 8 is a structural schematic diagram of the first shaft in another embodiment of the present application.
Figure 9:
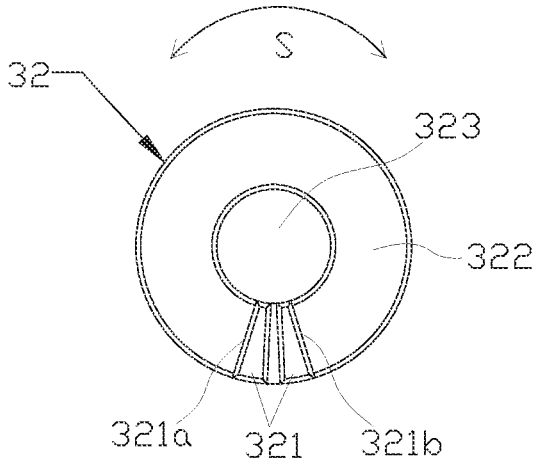
FIG. 9 is a structural schematic diagram of the second shaft in another embodiment of the present application.

As shown in FIG. 8 and FIG. 9, in an achievable manner, the number of the first limiting portion 311 is two, and the two first limiting portions 311 are spaced from each other along the rotation direction S of the second shaft 32. The first limiting surface 311*a* and the second limiting surface 311*b* are separately formed on different first limiting portions 311. The number of the second limiting portion 321 is two, and the two second limiting portions 321 are spaced from each other along the rotation direction S of the second shaft 32. The first stopping surface 321*a* and the second stopping surface 321*b* are separately formed on different second limiting portions 321. In this case, in order to ensure that the first limiting portion 311 can abut against the second limiting portion 321 when the handrail 2 is in both the unfolded and folded states, the spacing between the two first limiting portions 311 and/or the spacing between the two second limiting portions 321 can be adjusted as needed.

It is noted that, in other embodiments, it can also be one first limiting portion 311 and two second limiting portions 321, or two first limiting portions 311 and one second limiting portion 321.

In an achievable manner, both the first shaft 31 and the second shaft 32 are made of metal material (such as stainless steel material). The first limiting portion 311 and the first shaft 31 are an integral structure, and the second limiting portion 321 and the second shaft 32 are an integral structure. That is, both the first limiting portion 311 and the second limiting portion 321 are also made of metal material.

In an achievable manner, both the first limiting portion 311 and the second limiting portion 321 are made of magnetic material. The first limiting portion 311 and the second limiting portion 321 can attract with each other, so that the first limiting portion 311 and the second limiting portion 321 can be more stably limited after they abut against with each other, further avoiding the free rotation of the handrail 2 in the folded state. For example, both the first limiting portion 311 and the second limiting portion 321 are magnetic blocks (such as magnetic steel, magnets, etc.). The first limiting surface 311*a* of the first limiting portion 311 has opposite magnetic properties to the first stopping surface 321*a* of the second limiting portion 321, and the second limiting surface 311*b* of the first limiting portion 311 has opposite magnetic properties to the second stopping surface 321*b* of the second limiting portion 321. Alternatively, one of the first limiting portion 311 and the second limiting portion 321 is a magnetic block, and the other is a metal block (such as an iron block) that can be attracted to the magnetic block.

Figure 3:
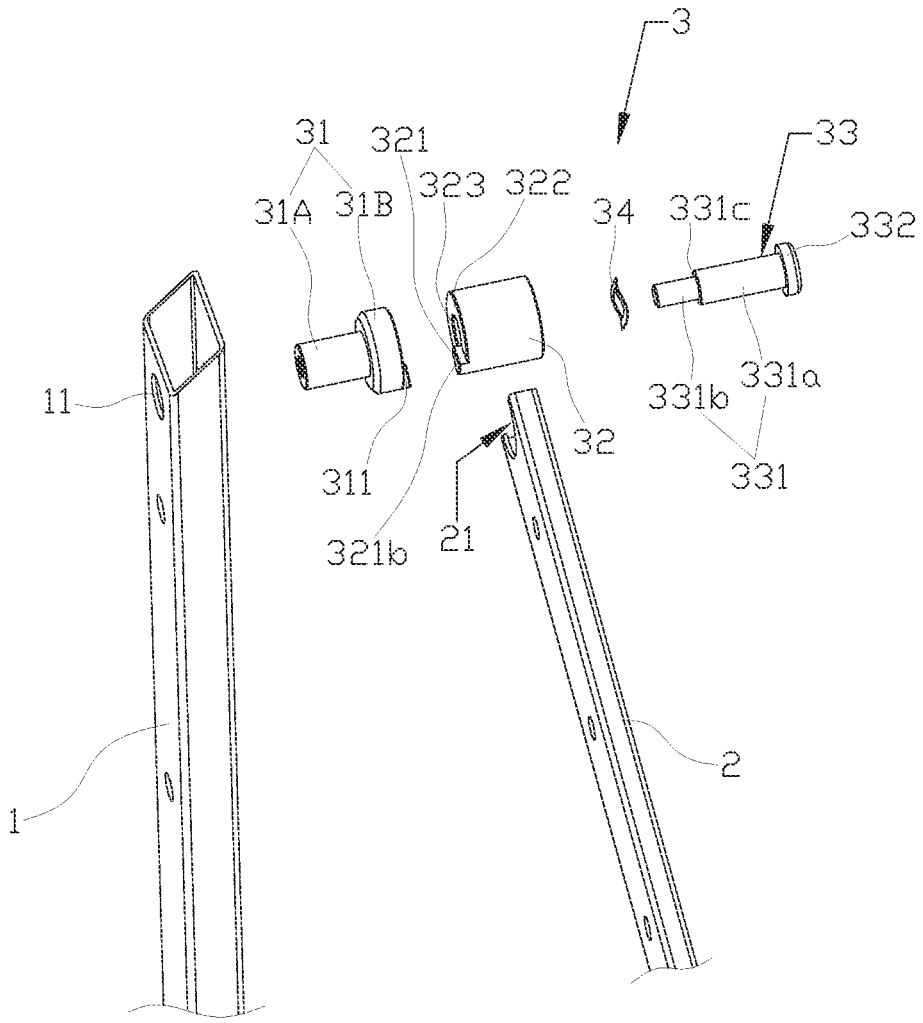
FIG. 3 is an explosive, structural schematic diagram of FIG. 1.
Figure 4:
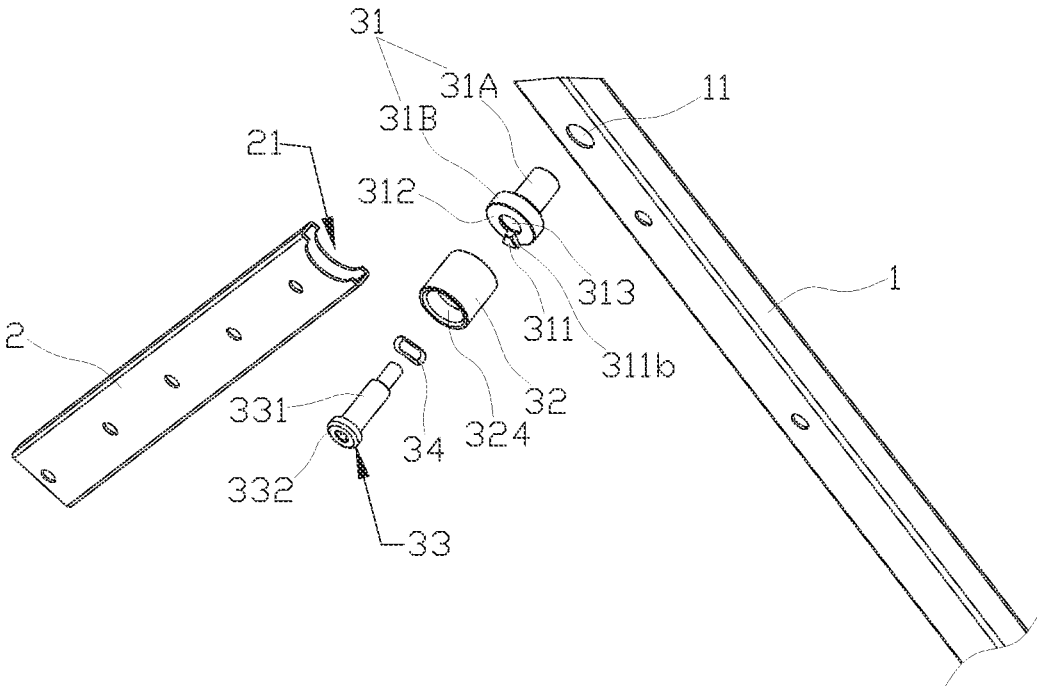
FIG. 4 is an explosive, structural schematic diagram of FIG. 1 from another view angle.
Figure 5:
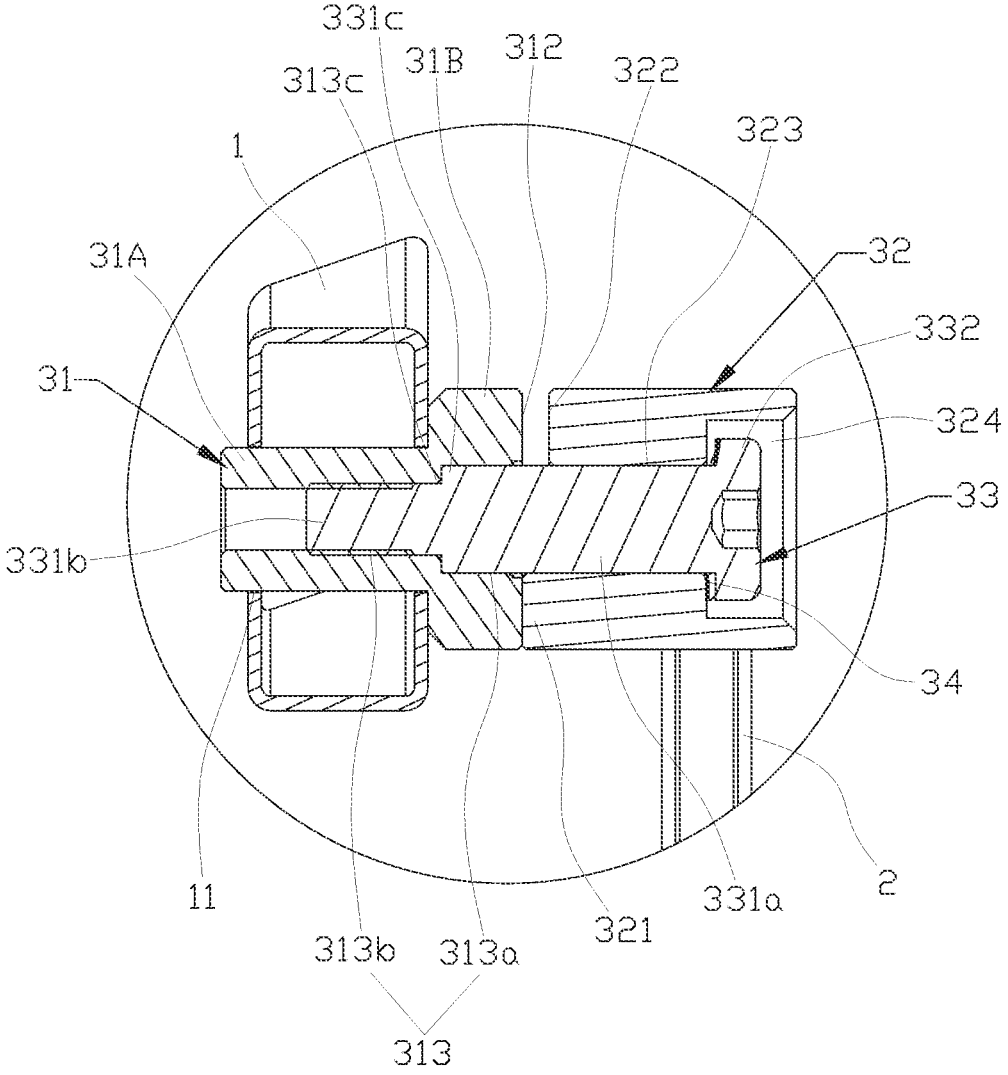
FIG. 5 is a partially cross-sectional, structural schematic diagram of FIG. 1.

As shown in FIG. 3 to FIG. 5, in an achievable manner, the pin 33 is fixedly connected to the first shaft 31. The second shaft 32 is rotatably connected to the pin 33, and the second shaft 32 can rotate relative to the pin 33. The hinge assembly 3 further includes a corrugated gasket 34 sleeved on the pin 33, and the corrugated gasket 34 contacts an end face of the second shaft 32 that is away from the first shaft 31. Of course, in other embodiments, the pin 33 can also be fixedly connected to the second shaft 32, and the first shaft 31 is rotationally connected to the pin 33.

Specifically, the corrugated gasket 34, also known as a wave washer, is a circular thin sheet with a regular wavy shape. The corrugated gasket 34 can not only prevent the loosening of the pin 33 and slow down the impact, but also increase the rotational resistance of the second shaft 32. On the one hand, the corrugated gasket 34 can slow down the rotational speed of the handrail 2 during rotation, increase the safety of use, and extend the service life of the components (to prevent the handrail 2 from rotating too fast and causing a large impact force on the first limiting portion 311 and the second limiting portion 321 when in contact); on the other hand, the corrugated gasket 34 can further avoid the free rotation of the handrail 2 in the unfolded and folded states.

As shown in FIG. 3 to FIG. 5, in an achievable manner, the pin 33 includes a rod 331 and a stop portion 332 which are interconnected to each other, with the outer diameter of the stop portion 332 greater than that of the rod 331. The second shaft 32 and the first shaft 31 are both cylindrical structures, the rod 331 is inserted into both the second shaft 32 and the first shaft 31, one end of the rod 331 that is far away from the stop portion 332 is fixedly connected to the first shaft 31, and the second shaft 32 can rotate relative to the rod 331. The stop portion 332 is located at one end of the second shaft 32 away from the first shaft 31. The corrugated gasket 34 is sandwiched between the stop portion 332 and the end face of the second shaft 32 that is away from the first shaft 31.

As shown in FIG. 3 to FIG. 5, in an achievable manner, a through hole 323 is provided in the second shaft 32, and the through hole 323 runs axially through the second shaft 32. A mounting hole 313 is axially provided in the first shaft 31. The rod 331 is inserted into the mounting hole 313 after passing through the through hole 323. The inner wall of the mounting hole 313 is provided with a first step 313*c*, the outer wall of the rod 331 is provided with a second step 331*c*, and the second step 331*c* abuts against the first step 313*c*.

Specifically, in this embodiment, the mounting hole 313 includes a first inner hole 313*a* and a second inner hole 313*b* which are interconnected to each other, with the first inner hole 313*a* located on one side of the second inner hole 313*b* near the second shaft 32. The diameter of the first inner hole 313*a* is greater than that of the second inner hole 313*b*, and the first step 313*c* is formed between of the first inner hole 313*a* and the second inner hole 313*b*. The rod 331 includes a first rod section 331*a* and a second rod section 331*b* which are interconnected to each other. The first rod section 331*a* is located between the stop portion 332 and the second rod section 331*b*. The outer diameter of the first rod section 331*a* is greater than that of the second rod section 331*b*, and the second step 331*c* is formed between the first rod section 331*a* and the second rod section 331*b*. The second rod section 331*b* is received in the second inner hole 313*b*, one end of the first rod section 331*a* near the second rod section 331*b* is received in the first inner hole 313*a*, and the second step 331*c* abuts against the first step 313*c*. Therefore, during assembly, the first step 313*c* and the second step 331*c* can play a role in stopping and positioning, which is not only convenient for installation, but also prevents the pin 33 from excessively compressing the second shaft 32 and the first shaft 31 to affect the normal rotation of the second shaft 32.

As shown in FIG. 3 to FIG. 5, in an achievable manner, the rod 331 is provided with an external thread (not shown) on the outer wall corresponding to the position of the first shaft 31 (that is, corresponding to the position of the mounting hole 313), and the inner wall of the first shaft 31 is provided with an internal thread (not shown, i.e., the inner wall of the mounting hole 313 is provided with an internal thread). The rod 331 is threadedly connected to the first shaft 31, so that the pin 33 is fixedly connected to the first shaft 31. The outer wall of the rod 331 corresponding to the position of the second shaft 32 (that is, corresponding to the position of the through hole 323) is a smooth structure (that is, no external thread is provided), allowing the second shaft 32 to rotate smoothly relative to the pin 33.

In an achievable manner, the pin 33 is a half tooth screw.

As shown in FIG. 5, in an achievable manner, the mounting hole 313 runs axially through the first shaft 31, and the distal end of the rod 331 (that is, the end far away from the stop portion 332) does not extend to the outside of the mounting hole 313. In another achievable manner, the distal end of the rod 331 extends to the outside of the mounting hole 313, and a nut (not shown) is provided on the distal end of the rod 331 to further fix the pin 33 to the first shaft 31.

As shown in FIG. 4 and FIG. 5, in an achievable manner, an accommodating groove 324 is provided in the end face of the second shaft 32 that is away from the first shaft 31, and the stop portion 332 is accommodated in the accommodating groove 324, thereby improving the aesthetics and safety. The corrugated gasket 34 is sandwiched between the stop portion 332 and the inner wall of the accommodating groove 324.

As shown in FIG. 1 and FIG. 3 to FIG. 5, in an achievable manner, the first shaft 31 is fixed to the pillar 1 by welding. The first shaft 31 includes an insertion portion 31A and an abutting portion 31B which are interconnected to each other, with the outer diameter of the abutting portion 31B greater than that of the insertion portion 31A. The pillar 1 is provided with a fixing hole 11, the insertion portion 31A is inserted into the fixing hole 11, and the abutting portion 31B abuts against the side wall of the pillar 1. Therefore, the welding area between the first shaft 31 and the pillar 1 is increased, thereby improving the stability and firmness of the connection between the first shaft 31 and the pillar 1.

As shown in FIG. 1, FIG. 3, and FIG. 4, in an achievable manner, the second shaft 32 is fixed to the handrail 2 by welding. One end of the handrail 2 is provided with a semi-circular groove 21, and the inner wall of the semi-circular groove 21 is a circular arc structure. The shape of the inner wall of the semi-circular groove 21 is adapted to the shape of the outer wall of the second shaft 32. The second shaft 32 is disposed in the semi-circular groove 21, and the outer wall of the second shaft 32 is in contact with the inner wall of the semi-circular groove 21. Therefore, it can facilitate the welding operation between the second shaft 32 and the handrail 2, and the end of the handrail 2 is in a circular arc shape, thereby improving the aesthetics.

This embodiment further provides a treadmill including the handrail folding structure for treadmill as described above.

The handrail folding structure for treadmill in the embodiments of the present application includes a hinge assembly 3. The hinge assembly 3 includes a first shaft 31 fixed on the pillar 1 and a second shaft 32 fixed on the handrail 2. The second shaft 32 is rotatably connected to the first shaft 31 through a pin 33, allowing the handrail 2 to rotate relative to the pillar 1, thereby enabling the handrail 2 to unfold and fold. Meanwhile, by setting the first limiting portion 311 and the second limiting portion 321 respectively on the first shaft 31 and the second shaft 32, the first limiting portion 311 and the second limiting portion 321 can abut against and cooperate with each other. When the handrail 2 is in an unfolded state, the first limiting portion 311 abuts against the second limiting portion 321, thereby keeping the handrail 2 in the unfolded state. When the handrail 2 is in a folded state, the first limiting portion 311 also abuts against the second limiting portion 321, thereby limiting the handrail 2 and reducing or avoiding the wear and safety issues caused by the free rotation of the handrail 2 in the folded state. The handrail folding structure for treadmill not only can limit the position of the handrail 2 in the unfolded and folded states, but also has a simple structure, high reliability, and is easy to install and disassemble.

The above are only the specific embodiments of the present application, but the scope of protection of the present application is not limited to this. Any technical personnel familiar with this technical field who can easily think of changes or replacements within the scope of technology disclosed in the present application should be covered within the scope of protection of the present application. Therefore, the protection scope of the present application should be based on the protection scope of the claims.

What is claimed is:

1. A handrail folding structure for a treadmill, the handrail folding structure comprising a pillar (1), a handrail (2), and a hinge assembly (3), wherein the hinge assembly (3) comprises a first shaft (31), a second shaft (32), and a pin (33), wherein the first shaft (31) is fixed on the pillar (1), the second shaft (32) is fixed on the handrail (2), the second shaft (32) is rotationally connected to the first shaft (31) through the pin (33), the second shaft (32) can rotate relative to the first shaft (31), wherein the pin (33) is fixedly connected to the first shaft (31), and the second shaft (32) is rotatably connected to the pin (33);

the first shaft (31) is provided with a first limiting portion (311), and the second shaft (32) is provided with a second limiting portion (321) for abutting against and cooperating with the first limiting portion (311), the first limiting portion (311) is located on a rotation path of the second limiting portion (321), and when the handrail (2) is in an unfolded or folded state, the first limiting portion (311) abuts against the second limiting portion (321).

2. The handrail folding structure for the treadmill as claimed in claim 1, wherein along a rotation direction(S) of the second shaft (32), the first limiting portion (311) has a first limiting surface (311*a*) and a second limiting surface (311*b*) which are located at two opposite sides of the first limiting portion (311), and the second limiting portion (321) has a first stopping surface (321*a*) and a second stopping surface (321*b*) which are located at two opposite sides of the second limiting portion (321);

when the handrail (2) is in the unfolded state, the first stopping surface (321*a*) abuts against the first limiting surface (311*a*), and when the handrail (2) is in the folded state, the second stopping surface (321*b*) abuts against the second limiting surface (311*b*).

3. The handrail folding structure for the treadmill as claimed in claim 2, wherein a number of the first limiting portion (311) is one, and the first limiting surface (311*a*) and the second limiting surface (311*b*) are both formed on a same first limiting portion (311); or, the number of the first limiting portion (311) is two, and the two first limiting portions (311) are spaced from each other along the rotation direction(S) of the second shaft (32), the first limiting surface (311*a*) and the second limiting surface (311*b*) are separately formed on different first limiting portions (311).

4. The handrail folding structure for the treadmill as claimed in claim 2, wherein a number of the second limiting portion (321) is one, and the first stopping surface (321*a*) and the second stopping surface (321*b*) are both formed on a same second limiting portion (321); or, the number of the second limiting portion (321) is two, and the two second limiting portions (321) are spaced from each other along the rotation direction(S) of the second shaft (32), the first stopping surface (321*a*) and the second stopping surface (321*b*) are separately formed on different second limiting portions (321).

5. The handrail folding structure for the treadmill as claimed in claim 1, wherein the first shaft (31) has a first end face (312) facing the second shaft (32), the second shaft (32) has a second end face (322) facing the first shaft (31), the first end face (312) faces and is spaced apart from the second end face (322), the first limiting portion (311) is protruded on the first end face (312), and the second limiting portion (321) is protruded on the second end face (322).

6. The handrail folding structure for the treadmill as claimed in claim 5, wherein both the first shaft (31) and the second shaft (32) are cylindrical structures, and the first shaft (31) and the second shaft (32) are arranged coaxially.

7. The handrail folding structure for the treadmill as claimed in claim 1, wherein the pin (33) comprises a rod (331) and a stop portion (332) which are interconnected to each other, with an outer diameter of the stop portion (332) greater than that of the rod (331); the rod (331) is inserted into both the second shaft (32) and the first shaft (31), one end of the rod (331) that is far away from the stop portion (332) is fixedly connected to the first shaft (31), the second shaft (32) can rotate relative to the rod (331), and the stop portion (332) is located at one end of the second shaft (32) away from the first shaft (31).

8. The handrail folding structure for the treadmill as claimed in claim 7, wherein the hinge assembly (3) further comprises a corrugated gasket (34) sleeved on the pin (33), and the corrugated gasket (34) is sandwiched between the stop portion (332) and one end face of the second shaft (32) that is away from the first shaft (31).

9. The handrail folding structure for the treadmill as claimed in claim 7, wherein a through hole (323) is provided in the second shaft (32), the through hole (323) runs axially through the second shaft (32), a mounting hole (313) is axially provided in the first shaft (31), and the rod (331) is inserted into the mounting hole (313) after passing through the through hole (323).

10. The handrail folding structure for the treadmill as claimed in claim 9, wherein an inner wall of the mounting hole (313) is provided with a first step (313*c*), an outer wall of the rod (331) is provided with a second step (331*c*), and the second step (331*c*) abuts against the first step (313*c*).

11. The handrail folding structure for the treadmill as claimed in claim 10, wherein the mounting hole (313) comprises a first inner hole (313*a*) and a second inner hole (313*b*) which are interconnected to each other, with a diameter of the first inner hole (313*a*) greater than that of the second inner hole (313*b*), and the first step (313*c*) is formed between the first inner hole (313*a*) and the second inner hole (313*b*); the rod (331) comprises a first rod section (331*a*) and a second rod section (331*b*) which are interconnected to each other, with an outer diameter of the first rod section (331*a*) greater than that of the second rod section (331*b*), and the second step (331*c*) is formed between the first rod section (331*a*) and the second rod section (331*b*), wherein the second rod section (331*b*) is received in the second inner hole (313*b*), and one end of the first rod section (331*a*) near the second rod section (331*b*) is received in the first inner hole (313*a*).

12. The handrail folding structure for the treadmill as claimed in claim 7, wherein the rod (331) is provided with an external thread on an outer wall of the rod (331) corresponding to a position of the first shaft (31), an inner wall of the first shaft (31) is provided with an internal thread, and the rod (331) is threadedly connected to the first shaft (31).

13. The handrail folding structure for the treadmill as claimed in claim 7, wherein an accommodating groove (324) is provided in an end face of the second shaft (32) that is away from the first shaft (31), and the stop portion (332) is accommodated in the accommodating groove (324).

14. The handrail folding structure for the treadmill as claimed in claim 1, wherein the first shaft (31) comprises an insertion portion (31A) and an abutting portion (31B) which are interconnected to each other, with an outer diameter of the abutting portion (31B) greater than that of the insertion portion (31A); the pillar (1) is provided with a fixing hole (11), the insertion portion (31A) is inserted into the fixing hole (11), the abutting portion (31B) abuts against a side wall of the pillar (1), and the first shaft (31) is fixed to the pillar (1) by welding.

15. The handrail folding structure for the treadmill as claimed in claim 1, wherein one end of the handrail (2) is provided with a semi-circular groove (21), the second shaft (32) is disposed in the semi-circular groove (21), an outer wall of the second shaft (32) is in contact with an inner wall of the semi-circular groove (21), and the second shaft (32) is fixed to the handrail (2) by welding.

16. A treadmill, comprising the handrail folding structure as claimed in claim 1.

* * * * *